US009387674B2

(12) United States Patent
Nakao et al.

(10) Patent No.: US 9,387,674 B2
(45) Date of Patent: Jul. 12, 2016

(54) FLOW PATH UNIT AND LIQUID EJECTING APPARATUS EQUIPPED WITH FLOW PATH UNIT

(71) Applicant: Seiko Epson Corporation, Tokyo (JP)

(72) Inventors: Hajime Nakao, Azumino (JP); Eiji Natori, Chino (JP)

(73) Assignee: Seiko Epson Corporation (JP)

( * ) Notice: Subject to any disclaimer, the term of this patent is extended or adjusted under 35 U.S.C. 154(b) by 29 days.

(21) Appl. No.: 14/299,260

(22) Filed: Jun. 9, 2014

(65) Prior Publication Data

US 2014/0362141 A1 Dec. 11, 2014

(30) Foreign Application Priority Data

Jun. 10, 2013 (JP) ..... 2013-121388

(51) Int. Cl.
*B41J 2/05* (2006.01)
*B41J 2/14* (2006.01)

(52) U.S. Cl.
CPC ..... *B41J 2/14233* (2013.01); *B41J 2202/11* (2013.01)

(58) Field of Classification Search
CPC ..... B41J 2/14233; B41J 2202/11
USPC ..... 347/65, 70, 71, 72, 68
See application file for complete search history.

(56) References Cited

U.S. PATENT DOCUMENTS 6,702,429 B2 * 3/2004 Lin ..... B41J 2/1404 347/65
7,090,340 B2 * 8/2006 Tobita et al. ..... 347/68
8,602,533 B2 * 12/2013 Fukada et al. ..... 347/68
2006/0061633 A1 * 3/2006 Nakayama ..... B41J 2/14209 347/71
2008/0259133 A1 * 10/2008 Hara ..... H01L 41/0973 347/70
2013/0063530 A1 * 3/2013 Higashino ..... B41J 2/14233 347/71

FOREIGN PATENT DOCUMENTS

JP 2001-199063 A 7/2001

* cited by examiner

*Primary Examiner* — Henok Legesse
(74) *Attorney, Agent, or Firm* — Harness, Dickey & Pierce, P.L.C.

(57) ABSTRACT

A flow path unit includes a pressure chamber substrate in which a plurality of pressure chambers are arranged in a first direction; and a piezoelectric element that changes a volume of the pressure chamber, in which a plane shape of an active section of the piezoelectric element is contained such that a width on one side thereof in a second direction crossing the first direction is wider than that on the other side in the second direction. The side on which the width of the active section of the piezoelectric element is great and the side on which the width thereof is smaller in the second direction be alternately disposed each other so that the active sections adjacent to each other are arranged differently from each other in the first direction.

16 Claims, 9 Drawing Sheets

FLOW PATH UNIT AND LIQUID EJECTING APPARATUS EQUIPPED WITH FLOW PATH UNIT

BACKGROUND

1. Technical Field

The present invention relates to a flow path unit and a liquid ejecting apparatus equipped with the flow path unit.

2. Related Art

In a liquid ejecting head such as an ink jet head, in order to obtain a high quality output result, densification of nozzles is promoted. The densification of nozzles similarly accompanies densification of pressure chambers which supply the liquid to each of the nozzles. Therefore, a partition wall between the pressure chambers is likely to be thin and then vibration caused by deformation that occurs in a certain pressure chamber is transmitted to the adjacent pressure chamber through the partition wall, such that, a so-called crosstalk may occur. Since the crosstalk affects behavior of the adjacent pressure chamber, it is necessary to suppress the crosstalk.

As described in the related art, an ink jet head is known in which rigidity of a thick part of the partition wall of the pressure chamber that separates between adjacent pressure chambers is increased, and the crosstalk to the pressure chamber is reduced by the partition wall of the pressure chamber (see FIG. 1 of JP-A-2001-199063).

It is desired to accomplish the densification and reduction of the crosstalk as described above simultaneously.

SUMMARY

An advantage of some aspects of the invention is to provide a flow path unit available in both, densification of pressure chambers and reduction of crosstalk, and a liquid ejecting apparatus equipped with the flow path unit.

According to an aspect of the invention, a flow path unit includes: a pressure chamber substrate in which a plurality of pressure chambers are arranged in a first direction; and a piezoelectric element that changes a volume of the pressure chamber, in which a plane shape of an active section of the piezoelectric element is contained such that a width on one side thereof in a second direction crossing the first direction is wider than that on the other side in the second direction.

Further, according to another aspect of the invention, a flow path unit includes: a pressure chamber substrate in which a plurality of pressure chambers are arranged in a first direction; and a piezoelectric element that changes a volume of the pressure chamber, in which a plane shape of the pressure chamber is contained such that a width on one side thereof in a second direction crossing the first direction is wider than that on the other side in the second direction.

In this case, the plane shape of at least one of the active section of the piezoelectric element and the pressure chamber is contained such that the width on one side in the second direction crossing the first direction is great and the width on the other side in the second direction is smaller. Therefore, even if densification (increase in the number of the pressure chambers per certain distance in the first direction) of the pressure chambers is achieved, it is possible to suppress crosstalk through a partition wall separating the pressure chambers by presence of the side of the small width.

It is preferable that the side on which the width of the active section of the piezoelectric element is great and the side on which the width thereof is smaller in the second direction be alternately disposed away from each other so that the active sections adjacent to each other are arranged different from each other in the first direction.

Further, it is preferable that the side on which the width of the pressure chamber is great and the side on which the width thereof is smaller in the second direction be alternately disposed each other so that the pressure chambers adjacent to each other are arranged differently from each other in the first direction.

In this case, it is possible to promote the densification of the pressure chambers and the reduction of the crosstalk.

It is preferable that the active sections of the piezoelectric element adjacent to each other in the first direction be disposed to be shifted in the second direction.

It is preferable that the pressure chambers adjacent to each other in the first direction be disposed to be shifted in the second direction.

In this case, it is possible to promote the densification of the pressure chambers and the reduction of the crosstalk.

It is preferable that the pressure chamber communicates with a nozzle for ejecting a liquid on the side on which the width thereof is great. In this case, it is possible to secure an appropriate ejection amount of the liquid depending on a sufficient volume change.

Technical ideas according to the invention are not intended to be realized only by the form of the flow path unit and may be embodied by other things. For example, an apparatus (a liquid ejecting apparatus) equipped with the flow path unit described above may be regarded as one invention. Further, a manufacturing method for manufacturing the flow path unit described above or the liquid ejecting apparatus may be regarded as one invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Exemplary Overview of Flow Path Unit and Liquid Ejecting Apparatus

Figure 1:
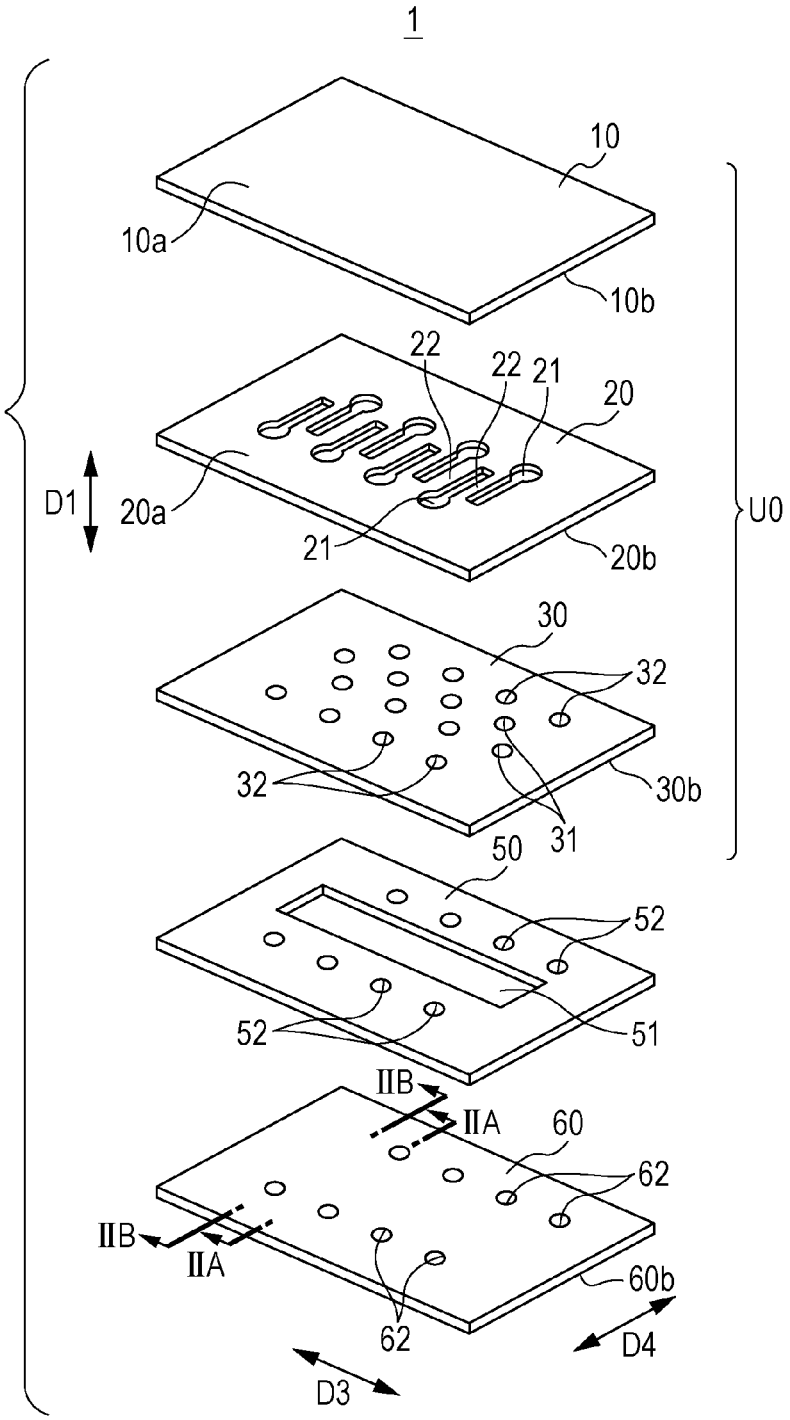
FIG. 1 is an exploded perspective view schematically illustrating a configuration of a liquid ejecting head.

FIG. 1 illustrates a schematic configuration of a liquid ejecting head 1 including a flow path unit U0.

Figure 2A:
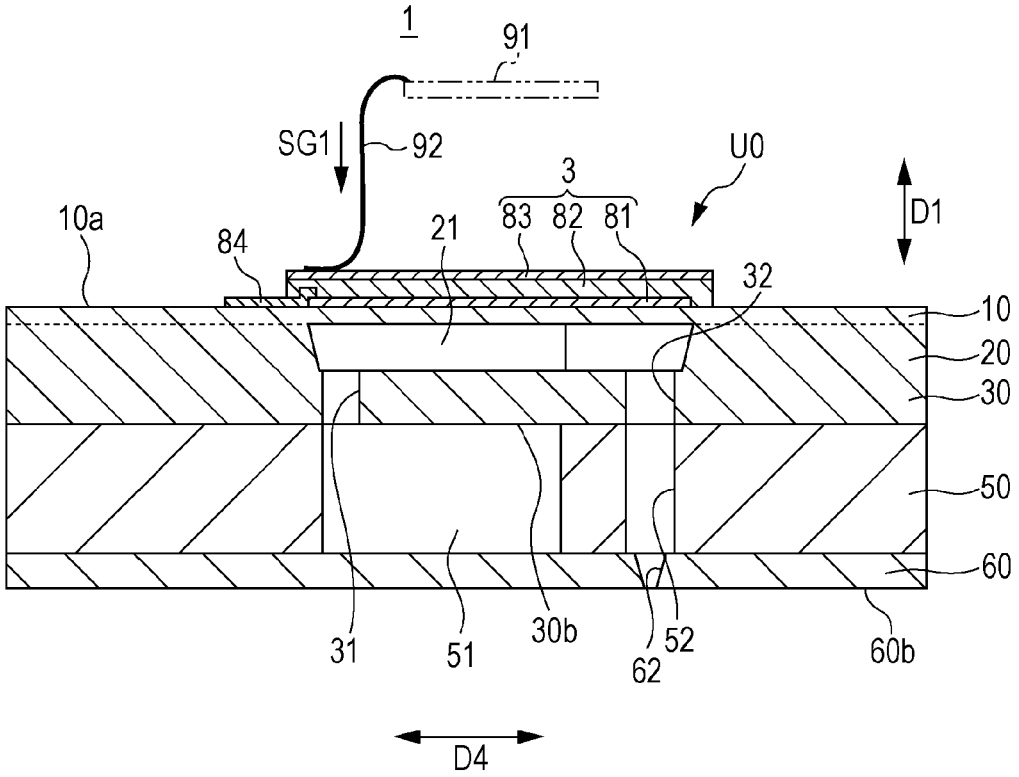
FIG. 2A is a cross-sectional view of the liquid ejecting head taken along line IIA-IIA of FIG. 1

FIG. 2A illustrates a cross-sectional view of the liquid ejecting head 1 taken along line IIA-IIA of FIG. 1.

Figure 2B:
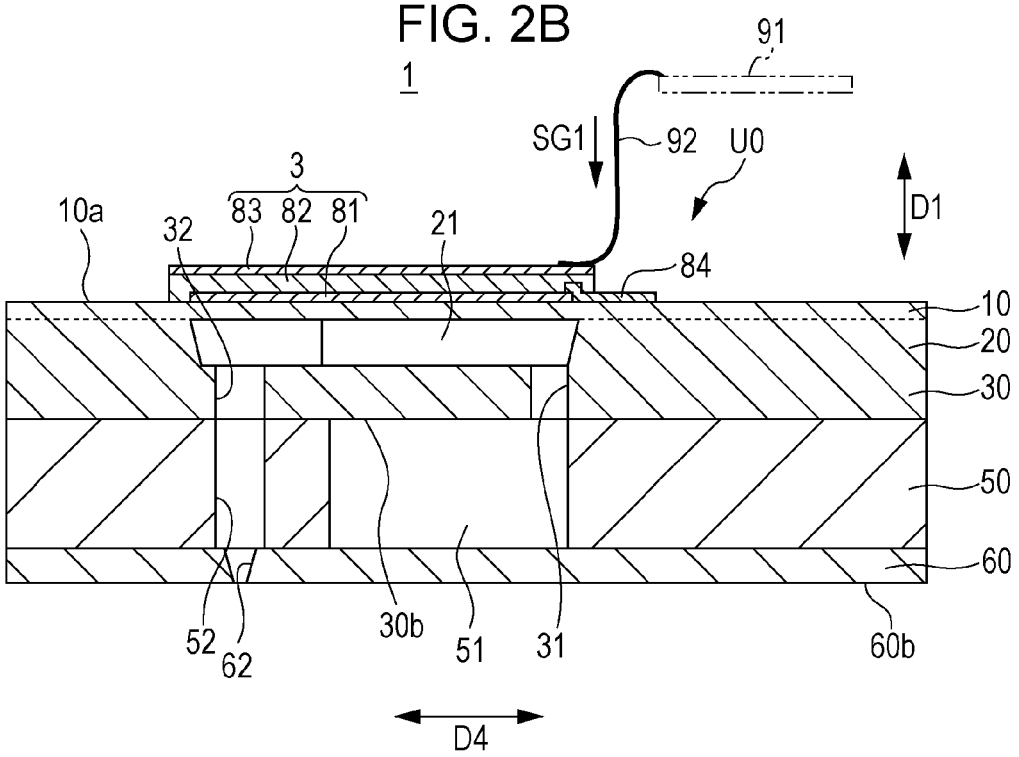
FIG. 2B is a cross-sectional view of the liquid ejecting head taken along line IIB-IIB of FIG. 1.

FIG. 2B illustrates a cross-sectional view of the liquid ejecting head 1 taken along line IIB-IIB of FIG. 1.

In the views, symbol D1 indicates a thickness direction of the flow path unit U0, symbol D3 indicates a longitudinal direction of the flow path unit U0, and symbol D4 indicates a lateral direction of the flow path unit U0. Directions D1, D3 and D4 are assumed to be orthogonal to each other, but may not be orthogonal if they intersect each other. For the sake of easy understanding, magnifications of directions D1, D3 and D4 may be different from each other, area ratios of a piezoelectric element 3 may be different from each other and views may not be consistent with each other.

A positional relationship described in the specification is intended to be merely exemplary for describing the invention and does not limit the invention. In addition, the same or, orthogonal direction or, position do not mean exactly the same, orthogonal and the like, and also mean including an error occurring during manufacturing and the like. Furthermore, contacting and bonding include both of the cases where adhesive is interposed therebetween and nothing is interposed therebetween.

Figure 9:
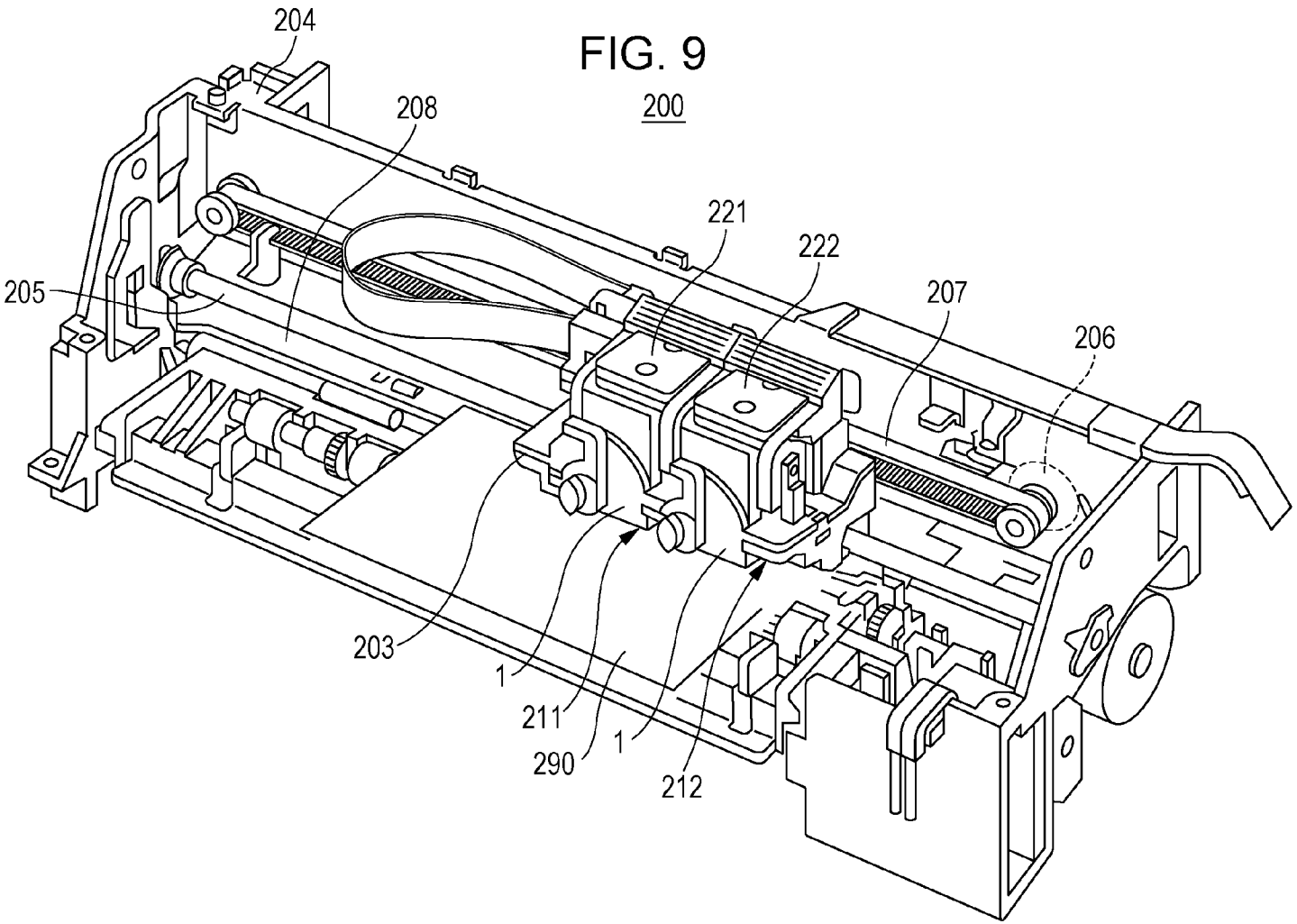
FIG. 9 is a schematic view illustrating an example of an ink jet printer.

The liquid ejecting head 1 illustrated in FIG. 1 includes the flow path unit U0 having each section indicated in symbols 10, 20 and 30, and nozzles 62 communicating with pressure chambers 21, and is an ink jet type recording head that ejects (discharges) ink (liquid). A liquid ejecting apparatus 200 illustrated in FIG. 9 is an ink jet printer (recording apparatus) equipped with the liquid ejecting head described above.

A vibration plate 10 seals one surface (surface 20*a*) of a spacer section 20. As illustrated in FIGS. 2A and 2B, the piezoelectric element 3, a lead electrode 84 and the like are provided on a surface 10*a* of the vibration plate 10 that is the opposite side of a back surface 10*b* coming into contact with the spacer section 20. Configurations mounted on the surface 10*a* are not illustrated in FIG. 1. The back surface 10*b* of the vibration plate 10 configures a part of a wall surface of the pressure chamber 21. The vibration plate 10 applies a pressure to a liquid inside the pressure chamber 21 by being deformed depending on a drive signal SG1 by the piezoelectric element 3.

The piezoelectric element 3 is a pressure generation section that has a piezoelectric layer 82, a lower electrode (a first electrode) 81 that is provided on the side of the pressure chamber 21 of the piezoelectric layer 82, and an upper electrode (a second electrode) 83 that is provided on the other side of the piezoelectric layer 82. The piezoelectric element 3 illustrated in FIGS. 2A and 2B is positioned in a position corresponding to each pressure chamber 21. For example, a control circuit substrate 91 for controlling the drive of the piezoelectric element 3 is connected to the upper electrode 83 through cables 92 such as a flexible substrate. One of the electrodes 81 and 83 may be a common electrode that is electrically connected to one of the electrodes 81 and 83 of another piezoelectric element 3. As a configuration metal of the upper and lower electrodes, for example, it is possible to use one or more of platinum (Pt), gold (Au), iridium (Ir), titanium (Ti) and the like. For example, as the piezoelectric layer 82, it is possible to use a ferroelectric body such as lead zirconate titanate (PZT), a material having a perovskite structure such as lead-free perovskite oxide and the like. The lead electrode 84 may be connected to the lower electrode 81 and may be connected to the upper electrode 83.

The pressure chamber 21 passing through in the thickness direction D1 is formed in the spacer section 20. The pressure chamber 21 is provided inside the flow path unit U0 by interposing the spacer section 20 between the vibration plate 10 and a connection section 30. In this sense, the flow path unit U0 includes at least a pressure chamber substrate in the claims. Each of the pressure chambers 21 is formed in an elongated shape towards the lateral direction D4 of the flow path unit U0 and a plurality of pressure chambers 21 are arranged in the longitudinal direction D3 of the flow path unit U0. A partition wall 22 is formed between the pressure chambers 21. A pressure is applied to the liquid inside the pressure chamber 21 by deformation of the vibration plate 10 that is a part of the wall. A plurality of columns of the pressure chambers 21 arranged toward the longitudinal direction D3 of the flow path unit U0 may be arranged in the lateral direction D4 of the flow path unit U0.

A liquid supply hole 31 and a communication hole 32 which are passing through toward the thickness direction D1 in positions that communicates with each of the pressure chambers 21 are formed in the connection section 30. That is, the connection section 30 seals the opposite side (back surface 20*b*) of the surface 20*a* in the spacer section 20 besides the holes 31 and 32. The supply hole 31 is provided in a position corresponding to one end section of the pressure chamber 21 in the longitudinal direction and the communication hole 32 is provided in a position corresponding to another end of the pressure chamber 21 in the longitudinal direction. Hereinafter, the side on which the supply hole 31 communicates with the pressure chamber 21 is referred to as an end section of the supply side and the side on which the communication hole 32 communicates with the pressure chamber 21 is referred to as an end section of the nozzle side. The holes 31 and 32, and the pressure chamber 21 become a flow path with which the liquid of the flow path unit U0 communicates.

A reservoir 51 and a communication hole 52 passing through toward the thickness direction D1 are formed in a reservoir plate 50 that is bonded to a back surface 30*b* of the connection section 30. The reservoir 51 is a common liquid chamber (common ink chamber) communicating with each of the supply holes 31 of the connection section 30 and a liquid supply route (not illustrated). Each of the communication holes 52 is provided in a position that communicates with each of the communication holes 32 of the connection section 30. The back surface 30*b* of the connection section 30 configures a plurality of the wall surfaces of the reservoir 51.

The nozzle 62 passing through in the thickness direction D1 is formed in a position communicating with each of the communication holes 52 in a nozzle plate 60 that is bonded to the opposite surface of the surface of the reservoir plate 50 bonding to the connection section 30. The back surface of the nozzle plate 60 is a nozzle surface 60*b* in which liquid droplets are ejected from the nozzle 62. The nozzle plate 60 illustrated in FIG. 1 has a nozzle column in which the nozzles 62 respectively communicating with the pressure chambers 21 are arranged toward a predetermined direction (D3) with predetermined gaps. A plurality of nozzles 62 illustrated in FIG. 1 are arranged in a so-called zigzag pattern.

The liquid ejecting head 1 may not have the reservoir plate 50. For example, in a case where the reservoir plate 50 does not exist, it is possible to bond the nozzle plate 60 to the flow path unit U0. In a case where the reservoir plate 50 is not provided, the function of the plate is performed by another plate. On the contrary, the liquid ejecting head 1 may have another plate (not illustrated) (for example, a sealing plate inserted between the reservoir plate 50 and the connection section 30). Further, the liquid ejecting head 1 may include another plate such as a so-called compliance plate and, for example, the compliance plate may be disposed between the reservoir plate 50 and the nozzle plate 60. Further, any of the plates described above may be configured to have a plurality of plates and, on the contrary, one plate may include functions of a plurality of plates.

In the example illustrated in FIG. 1, the plurality of the pressure chambers 21 arranged in the direction D3 are formed such that directions (directions of the end sections of the supply side) of adjacent end sections of the nozzle side are alternately disposed each other. Line IIA-IIA in FIG. 1 is a line that passes through the pressure chamber 21 in which the direction of the end section of the nozzle side faces one end side (the right side in FIG. 2A) of both ends in the direction D4. Line IIB-IIB in FIG. 1 is a line that passes through the pressure chamber 21 in which the direction of the end section of the nozzle side faces the other end side (the left side in FIG. 2B) of both ends in the direction D4.

In the liquid ejecting head 1 described above, the liquid such as ink fills inside of the reservoir 51 by introducing from the liquid supply route (not illustrated), and fills inside each of the pressure chambers 21 through each of the supply holes 31. When the piezoelectric element 3 deforms depending on a drive voltage (drive signal SG1) from the control circuit substrate 91 so as to deflect the vibration plate 10 toward the side of the pressure chamber 21, the vibration plate 10 also deforms accordingly. The volume of the pressure chamber 21 is changed by the deformation of the vibration plate 10 and the pressure of the liquid inside the pressure chamber 21 increases and then the liquid droplets are ejected from the nozzle 62 through the communication holes 32 and 52.

2. Description of Shape of Active Section and/or Pressure Chamber

Next, characteristic shapes of the piezoelectric element 3 and the pressure chamber 21 according to the embodiment are described.

Figure 3:
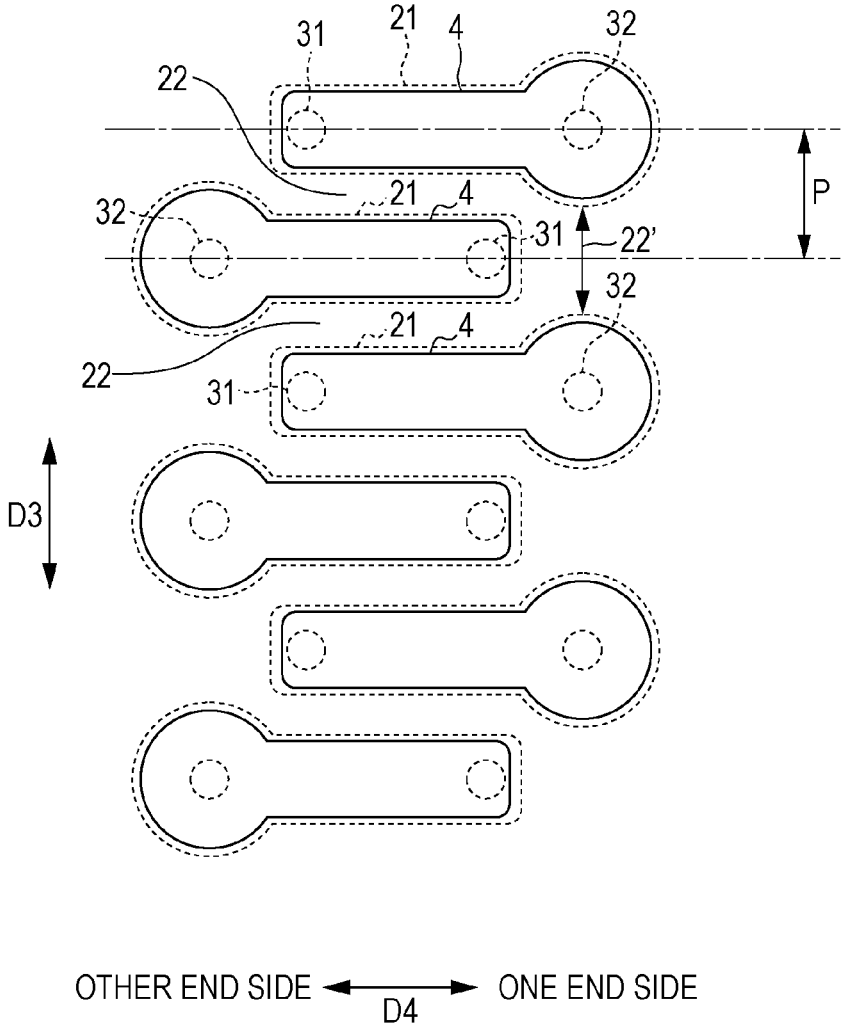
FIG. 3 is a view illustrating shapes and the like of active sections and pressure chambers.

FIG. 3 illustrates the shapes and the like of an active section 4 of the piezoelectric element 3 by the viewpoint of facing the surface 10*a*. The active section 4 means a range in which the lower electrode 81, the piezoelectric layer 82 and the upper electrode 83 of the piezoelectric element 3 are overlapped each other, is a range that is deformed depending on the drive signal SG1. The active section 4 is indicated by a solid line. Further, in FIG. 3, the shape of the pressure chamber 21 that is formed corresponding to the active section 4, the supply hole 31 and the communication hole 32 communicating with the inside of the pressure chamber 21 are indicated by chain lines. As illustrated in FIG. 3, a plane shape (a shape in a surface parallel to the direction D3 and the direction D4) of the active section 4 is formed such that a width (a width in the direction D3, referred to the same hereinafter) on a side corresponding to the end section of the nozzle side of the pressure chamber 21 is wider than that on a side corresponding to the end section of the supply side of the pressure chamber 21. Moreover, the direction D3 corresponds to "first direction" in the claims and the direction D4 corresponds to "second direction" in the claims.

Further, in the example of FIG. 3, the plane shape of the pressure chamber 21 is similar or substantially similar to the active section 4 and the width of the end section of the nozzle side is wider than that of the end section of the supply side. Further, directions of the active sections 4 and the pressure chambers 21 which are adhered to each other in the direction D3 are alternately disposed. That is, in the direction D3, the end section of the nozzle side having the wider width and the end section of the supply side having the smaller width are alternately disposed. Further, end sections (one end side and/or the other end side) of the active sections 4 and the pressure chambers 21 which are adhered to each other are not gathered in the direction D3 and are disposed shifted in the direction D4. In other words, in the active sections 4 and the pressure chambers 21 which are adhered to each other in the direction D3, the overlapping range in the direction D4 is a portion in which the width is narrower than that of the end section of the nozzle side. Further, when viewed from the direction D3, the region in which each of the active sections 4 and the pressure chambers 21 are overlapped becomes the region in which the width is narrow.

Here, a distance indicated by a symbol P is a distance between the pressure chambers 21 in the direction D3 and is also a distance (nozzle pitch) between the nozzles in the direction D3. Densification of the pressure chambers 21, that is, densification of the nozzles 62 is promoted by further narrowing the distance P.

In the embodiment, the piezoelectric element 3 (the active section 4) and the pressure chamber 21 employ the characteristic shapes as described above, thereby easily securing the thickness of the partition wall 22 separating the pressure chambers 21 therebetween. Therefore, it is possible to solve the two problems of the densification (densification of the nozzles 62) of the pressure chambers 21 and reduction of the crosstalk simultaneously. Further, since the width of the end section of the nozzle side of the pressure chamber 21 is secured relatively large in a position that does not interfere with the other pressure chamber 21, a displacement amount of the vibration plate 10 is sufficiently secured in the end section of the nozzle side. That is, a distance (a distance 22', see FIG. 3) in the direction D3 between the end sections of the nozzle side of the active sections 4 and the pressure chambers 21 in which the displacement amount of the vibration plate 10 is sufficiently secured is secured to be wider than a distance (gap, that is, the thickness of the partition wall 22) in the direction D3 between the end sections of the supply side of the active sections 4 and the pressure chambers 21 in which the displacement amount of the vibration plate 10 is small. Thus, in the embodiment, it is possible to avoid drawback in that an ejection amount of the liquid from the nozzle 62 is lowered due to shortage of a displacement amount of the vibration plate 10 in a case where the width of the pressure chamber 21 and the like are narrow.

3. Modification Example

The shapes of the active section 4 and the pressure chamber 21 are not limited to the example illustrated in FIG. 3 and may employ a plurality of modification examples described below.

Figure 4:
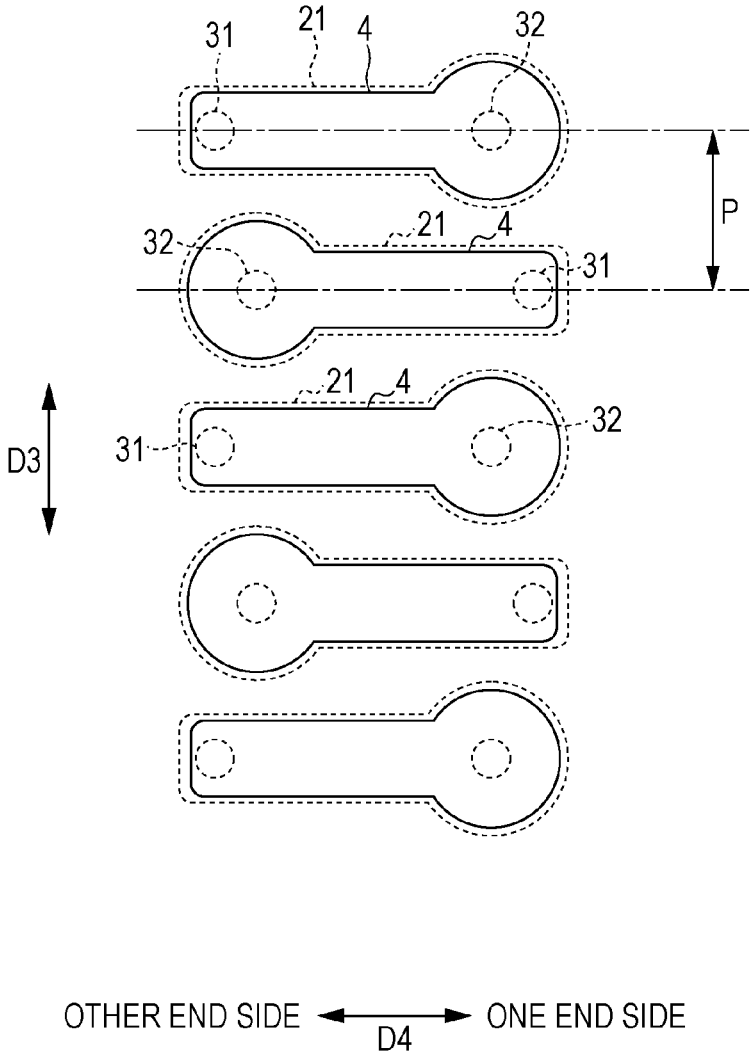
FIG. 4 is a view illustrating shapes and the like (Modification Example 1) of active sections and pressure chambers.

FIG. 4 illustrates shapes and the like of active sections 4 and pressure chambers 21 according to Modification Example 1 in the viewpoint similar to FIG. 3. The active sections 4 and the pressure chambers 21 which are adjacent to each other in the direction D3 may not be shifted in the direction D4. That is, FIG. 4 illustrates a configuration in which there is no shift in the direction D4 as illustrated in FIG. 3.

Figure 5:
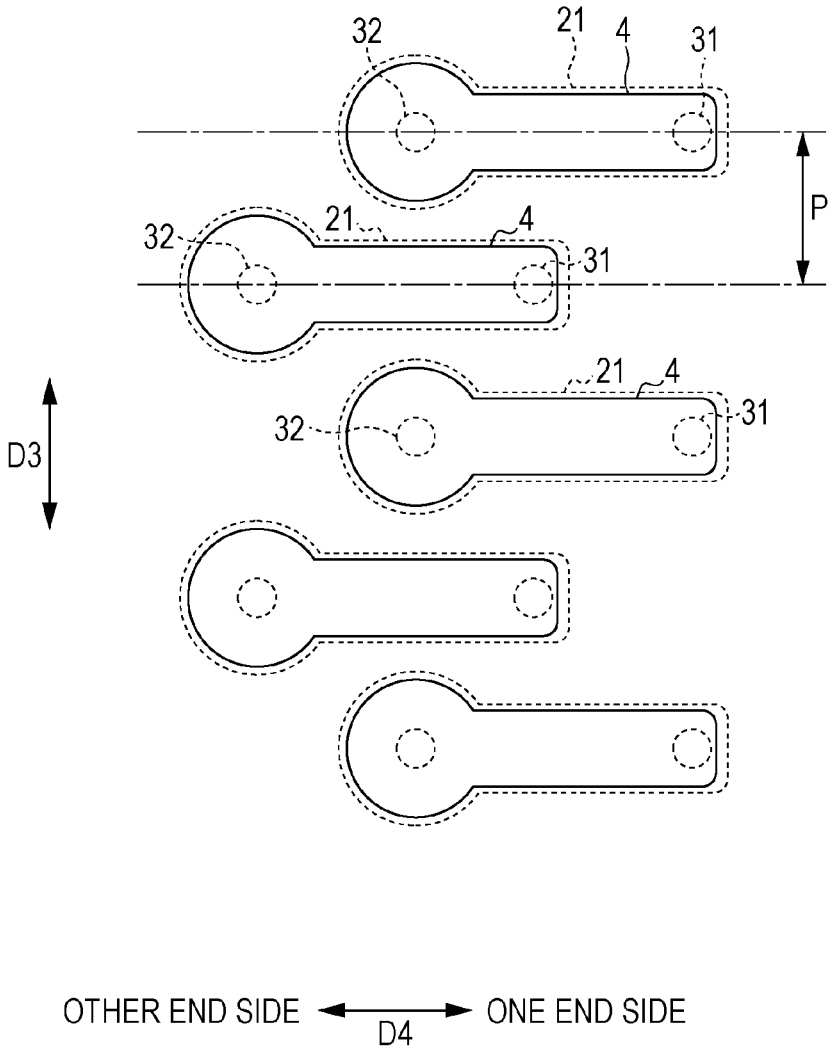
FIG. 5 is a view illustrating shapes and the like (Modification Example 2) of active sections and pressure chambers.

FIG. 5 illustrates shapes and the like of active sections 4 and pressure chambers 21 according to Modification Example 2 in the viewpoint similar to FIG. 3. Directions of the active sections 4 and the pressure chambers 21 which are adjacent to each other in the direction D3 may not be alternately disposed. That is, FIG. 5 illustrates a case where in both the active sections 4 and the pressure chambers 21, the portions in which the widths are wide are directed to the same side (for example, the other end side in the direction D4) in the direction D4.

Even when employing any part of Modification Examples 1 and 2, since the portion in which the width is narrow exists, it is easy to secure the thickness of the partition wall separating the pressure chambers 21 therebetween while narrowing the distance P. Therefore, it is possible to accurately suppress the crosstalk. When employing any part of Modification Example 1 and 2, it is difficult to employ the reservoir 51 of the embodiment illustrated in FIGS. 1 to 2B without any changes, but the number or the positions of reservoirs which are necessary for supplying the liquid to each of the pressure chambers 21 through each of the supply holes 31 may be secured.

Figure 6:
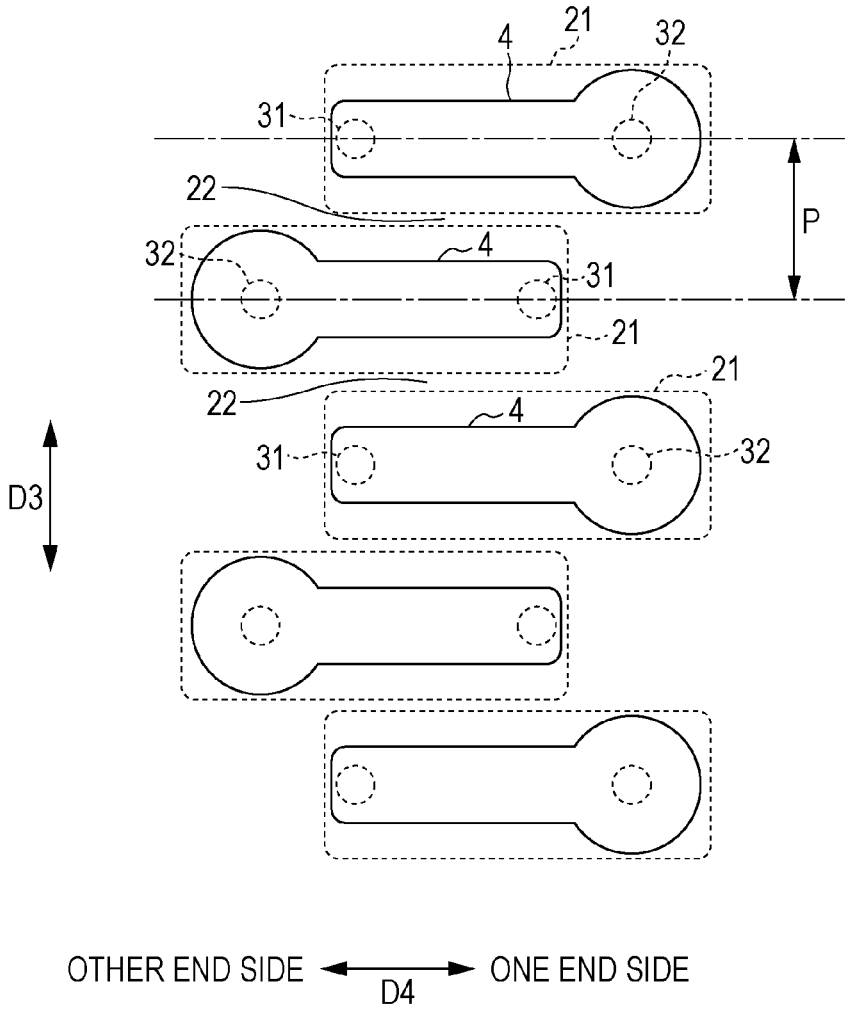
FIG. 6 is a view illustrating shapes and the like (Modification Example 3) of active sections and pressure chambers.

FIG. 6 illustrates shapes and the like of active sections 4 and pressure chambers 21 according to Modification Example 3 in the viewpoint similar to FIG. 3. The active section 4 and the pressure chamber 21 corresponding thereto may not be similar to each other. In FIG. 6, the shape of the active section 4 is similar to that in FIG. 3, but the pressure chamber 21 has a rectangular shape. In a case of employing the configuration, since the width of the pressure chamber 21 is widely secured in all ranges in the longitudinal direction (D4) of the pressure chamber 21, when narrowing the distance P, the partition wall 22 easily becomes thin compared to the example of FIG. 3 and the like. However, since the active section 4 has a shape in which the width thereof is narrow on the side corresponding to the end section of the supply side of the pressure chamber 21, the displacement of the active section 4 on the side corresponding to the end section of the supply side is unlikely to affect the adjacent pressure chamber 21. Therefore, it is possible to accurately suppress the crosstalk while narrowing the distance P.

Figure 7:
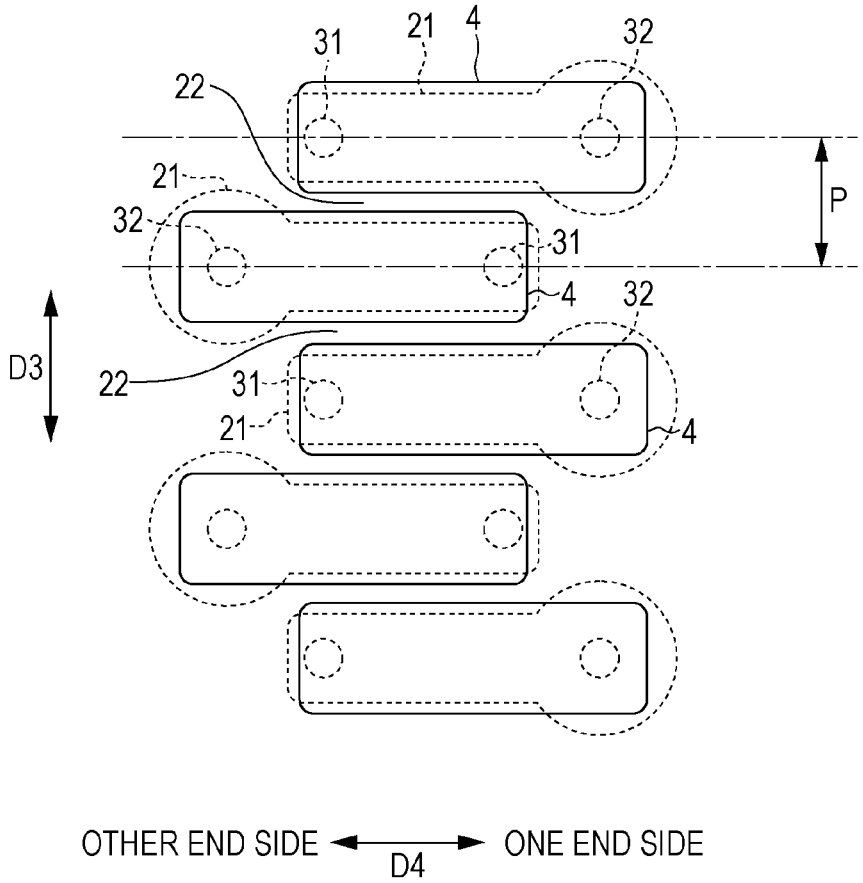
FIG. 7 is a view illustrating shapes and the like (Modification Example 4) of active sections and pressure chambers.

FIG. 7 illustrates shapes and the like of active sections 4 and pressure chambers 21 according to Modification Example 4 in the viewpoint similar to FIG. 3. In FIG. 7, the shape of the pressure chamber 21 is similar to that in FIG. 3, but the active section 4 has a rectangular shape. Also in a case of employing the configuration, similar to the example of FIG. 3 and the like, it is easy to secure the thickness of the partition wall 22 separating the pressure chambers 21 therebetween while narrowing the distance P. Therefore, it is possible to accurately suppress the crosstalk.

The shapes of the active section 4 and the pressure chamber 21 illustrated in any of FIGS. 6 and 7, and the arrangement of the active section 4 and the pressure chamber 21 illustrated in any of FIGS. 4 and 5 may be combined.

Further, the shape of the active section 4 or the pressure chamber 21 is not limited to the examples described above.

Figure 8A:
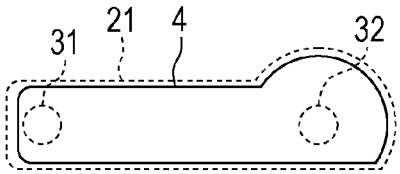
FIGS. 8A to 8C are views illustrating variations of the shapes of the active sections and the pressure chambers.
Figure 8B:
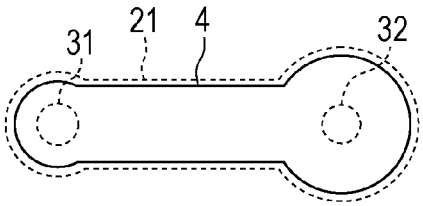
Figure 8C:
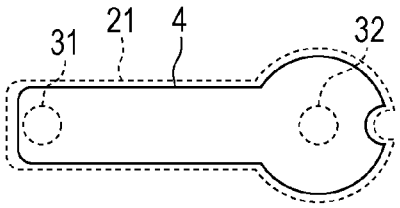

FIGS. 8A, 8B and 8C illustrate various variations of the shapes (shapes in which the width on the side corresponding to the end section of the nozzle side is wider than that on the side of corresponding to the end section of the supply side) of the active section 4 and the pressure chamber 21. As illustrated in FIG. 8A, for example, the active section 4 and the pressure chamber 21 may be an asymmetrical shape in the lateral direction thereof. Further, as illustrated in FIG. 8B, for example, in the active section 4 and the pressure chamber 21, the width on the side corresponding to the end section of the supply side may be wider than that of the portion in which the end section of the supply side and the end section of the nozzle side are connected within a range that the width on the side corresponding to the end section of the supply side is smaller than that on the side corresponding to the end section of the nozzle side. Further, as illustrated in FIG. 8C, for example, the active section 4 and the pressure chamber 21 may include a shape in which a part thereof is cut out. Of course, one of the active section 4 and the pressure chamber 21 may employ any one of the shapes illustrated in FIGS. 8A to 8C. Further, the portion of the active section 4 and the pressure chamber 21 in which the width thereof is narrow may be gradually narrowed toward the end section of the supply side.

4. Example of Liquid Ejecting Apparatus

FIG. 9 illustrates an appearance of the liquid ejecting apparatus 200 that is an ink jet type recording apparatus having the liquid ejecting head 1 described above as a recording head. When assembling the liquid ejecting head 1 to recording head units 211 and 212, it is possible to manufacture the liquid ejecting apparatus 200. In the liquid ejecting apparatus 200 illustrated in FIG. 9, the liquid ejecting head 1 is provided in each of the recording head units 211 and 212, and ink cartridges 221 and 222 which are external ink supply means are detachably provided in the recording head units 211 and 212. A carriage 203 equipped with the recording head units 211 and 212 is reciprocally provided along a carriage shaft 205 mounted on an apparatus body 204. When a drive force of a drive motor 206 is transmitted to the carriage 203 through a plurality of gears (not illustrated) and a timing belt 207, the carriage 203 moves along the carriage shaft 205. A recording medium 290 that is fed by a feeding roller (not illustrated) and the like is transported on a platen 208 and the printing is performed by the ink droplets that are supplied from the ink cartridges 221 and 222, and ejected from the liquid ejecting head 1.

Further, the liquid ejecting apparatus 200 may be a so-called line head type printer in which the liquid ejecting head is fixed so as not to move the liquid ejecting head during drive printing and the printing is performed only by moving the recording medium.

5. Application and Others

The liquid ejected from the liquid ejecting head may be a material capable of being ejected from the liquid ejecting head and includes fluids such as a solution in which dyes are dissolved in a solvent, and sol in which solid particles such as pigments or metal particles are dispersed in a dispersion medium. Such a fluid includes ink, liquid crystal and the like. The liquid ejecting head may be mounted on a manufacturing apparatus of a color filter for a liquid crystal display or the like, an electrode manufacturing apparatus for an organic EL display or a field emission display (FED) or the like, a biochip manufacturing apparatus, and the like in addition to the image recording apparatus such as the printer.

The piezoelectric element for applying the pressure to the pressure chamber is not limited to the thin film type as illustrated in FIGS. 2A and 2B, and may be a laminated type in which a piezoelectric material and an electrode material are alternately laminated.

Further, a configuration in which configurations disclosed in the embodiments or modification examples described above are mutually replaced with each other or a combination thereof is changed, a configuration in which configurations disclosed in known techniques, the embodiments or modification examples described above are mutually replaced with each other or a combination thereof is changed, and the like may be performed. The invention also includes those configurations.

The entire disclosure of Japanese Patent Application No. 2013-121388, filed Jun. 10, 2013 is expressly incorporated by reference herein.

What is claimed is:

1. A flow path unit comprising:

a pressure chamber substrate in which a plurality of pressure chambers are formed in a first direction next to each other;

a lower electrode that is provided above the pressure chamber substrate and that overlaps each of the plurality of pressure chambers;

a plurality of piezoelectric elements, each of the plurality of piezoelectric elements having an active section, each of the active sections configured to change a volume of each of the plurality of pressure chambers, each of the active sections being in a longitudinal shape and extending in a second direction perpendicular to the first direction;

an upper electrode that is provided on each of the plurality of piezoelectric elements and that overlaps each of the plurality of pressure chambers; and a communication hole connected to each of a plurality of nozzles, wherein in a plan view, each of the active sections has a widest width in the first direction located at one longitudinal end thereof, an overlapped area of the lower electrode, the piezoelectric element and the upper electrode is each of the active sections, and in the plan view, the communication hole is located completely within an area of the overlapped area and the one longitudinal end of each of the active sections.

2. The flow path unit according to claim 1, wherein the one longitudinal end and the other longitudinal end of adjacent active sections are oppositely arranged to each other in the first direction.

3. A liquid ejecting apparatus equipped with the flow path unit according to claim 2.

4. The flow path unit according to claim 1, wherein the active sections adjacent to each other in the first direction are disposed shifted in the second direction.

5. A liquid ejecting apparatus equipped with the flow path unit according to claim 4.

6. The flow path unit according to claim 1, wherein each of the plurality of pressure chambers communicates with each of the plurality of nozzles for ejecting a liquid from the one longitudinal end at which the widest width is located.

7. A liquid ejecting apparatus equipped with the flow path unit according to claim 6.

8. A liquid ejecting apparatus equipped with the flow path unit according to claim 1.

9. A flow path unit comprising:

a pressure chamber substrate in which a plurality of pressure chambers are formed in a first direction next to each other, each of the plurality of pressure chambers being in a longitudinal shape and extending in a second direction perpendicular to the first direction;

a lower electrode that is provided above the pressure chamber substrate and that overlaps each of the plurality of pressure chambers;

each of a plurality of piezoelectric elements configured to change a volume of each of the plurality of pressure chambers, that is provided on the lower electrode and that overlaps the each of the plurality of pressure chambers;

an upper electrode that is provided on the piezoelectric element and that overlaps the each of the plurality of pressure chambers; and a communication hole connected to each of a plurality of nozzles, wherein in a plan view, each of the plurality of pressure chambers has a widest width in the first direction located at one longitudinal end thereof, and an overlapped area of the lower electrode, the piezoelectric element and the upper electrode forms an active section, wherein a volume of each of the plurality of pressure chambers is configured to be changed by each corresponding active section; and in the plan view, the communication hole is located completely within an area of the overlapped area and a one longitudinal end of each of the active sections.

10. The flow path unit according to claim 9, wherein the one longitudinal end and the other longitudinal end of adjacent pressure chambers are oppositely arranged to each other in the first direction.

11. A liquid ejecting apparatus equipped with the flow path unit according to claim 10.

12. The flow path unit according to claim 9, wherein the plurality of pressure chambers adjacent to each other in the first direction are disposed shifted in the second direction.

13. A liquid ejecting apparatus equipped with the flow path unit according to claim 12.

14. The flow path unit according to claim 9, wherein the each of the plurality of pressure chambers communicates with each of the plurality of nozzles for ejecting a liquid from the one longitudinal end at which the widest width is located.

15. A liquid ejecting apparatus equipped with the flow path unit according to claim 14.

16. A liquid ejecting apparatus equipped with the flow path unit according to claim 9.

* * * * *